US007195422B2

(12) United States Patent
Hannah

(10) Patent No.: US 7,195,422 B2
(45) Date of Patent: Mar. 27, 2007

(54) RECESSED DELINEATOR POST BASE

(75) Inventor: Gregory L. Hannah, San Antonio, TX (US)

(73) Assignee: Impact Recovery Systems, Inc., San Antonio, TX (US)

( * ) Notice: Subject to any disclaimer, the term of this patent is extended or adjusted under 35 U.S.C. 154(b) by 0 days.

(21) Appl. No.: 11/362,245

(22) Filed: Feb. 24, 2006

(65) Prior Publication Data

US 2006/0193690 A1 Aug. 31, 2006

(51) Int. Cl.
*E01F 9/00* (2006.01)

(52) U.S. Cl. ..... 404/11; 404/9; 40/606.01

(58) Field of Classification Search ..... 40/606.01, 40/611.05; 404/9, 11; 116/63 R
See application file for complete search history.

(56) References Cited

U.S. PATENT DOCUMENTS

| | | | | | |
|---|---|---|---|---|---|
| 3,587,416 | A | | 6/1971 | Flanagan | |
| 4,147,447 | A | | 4/1979 | Heenan et al. | |
| 4,195,945 | A | | 4/1980 | Heenan | |
| 5,277,513 | A | | 1/1994 | Flanagan et al. | |
| 5,454,664 | A | | 10/1995 | Siblik | |
| 5,564,854 | A | * | 10/1996 | Hedgewick | 404/14 |
| 5,816,737 | A | | 10/1998 | Siblik | |
| 5,975,794 | A | * | 11/1999 | Hedgewick | 404/14 |
| D420,890 | S | * | 2/2000 | Kuhnke | D8/354 |
| 6,019,543 | A | * | 2/2000 | Junker | 404/10 |
| 6,036,400 | A | * | 3/2000 | Clark | 404/9 |
| 6,416,248 | B1 | * | 7/2002 | Clark | 404/10 |
| 6,457,566 | B1 | * | 10/2002 | Toby | 188/1.11 W |
| 6,616,369 | B2 | | 9/2003 | Clark | |
| 7,077,598 | B1 | * | 7/2006 | Leonhardt et al. | 404/9 |

FOREIGN PATENT DOCUMENTS

| | | |
|---|---|---|
| DE | 93 01 135.0 | 1/1993 |
| EP | 0112804 | 7/1984 |
| WO | WO 92/13139 | 8/1992 |

* cited by examiner

*Primary Examiner*—Gary S Hartmann
(74) *Attorney, Agent, or Firm*—Jackson Walker, LLP

(57) ABSTRACT

A recessed delinator base for disposition in grooves in a highway or traffic support surface has a body member with leg portions attached to the body and extending outwardly therefrom. The body has a circular notch formed therein to accept a traffic delineator knuckle assembly. Within the notch and extending upwardly from the bottom thereof are a plurality of spaced apart studs. Each stud has and enlarged head portion. At least one detent receiving hole is provided in the bottom of the notch for accepting a detent lock pin for securing the knuckle assembly from rotation once placed within the recessed circular notch in the base. The ramping or sloping legs urge a clearing implement to slide along the top-most portion of the body member thereby avoiding engagement with the knuckle attachment studs when the support surface is cleared or cleaned.

3 Claims, 6 Drawing Sheets

RECESSED DELINEATOR POST BASE

BACKGROUND OF THE INVENTION

This application relates to the design and function of a base or mount for a delineator post. More particularly it relates to a base or mount which will accept a rapid, easy connecting and disconnecting highway traffic delineator post. Further, the base or mount is recessed in the road or support surface such that a snowplow or other highway clearing device may pass over it without damaging the delineator mounting components within the base.

U.S. Pat. No. 6,616,369, which is incorporated herein for all purposes, discloses a quick release delineator apparatus which fits into a permanent or portable base for the delineator system. It is an intention of the present invention to provide a base and mount for such a releasable delineator apparatus, which is recessable within the support surface for the delineator.

Current U.S. Pat. Nos. 5,277,513; 5,454,664; 5,816,737; 4,195,945; 4,147,447; and 3,587,416 disclose low-profile snowplowable pavement markers which incorporate a reflector lens element. These patents do not teach or disclose that a traffic delineator may be substituted for the reflector element. However, there has been a long standing need to be able to provide a suitable base (which will accommodate a traffic delineator post) which may be plowed over by a snowplow blade or other surface clearing device.

Often times during highway construction, delineators must be placed along the highway to direct traffic around the worksite. These delineators may be attached to a mount or base which is permanently affixed to the roadway or support surface. In some situations, the delineator may be disconnected from the base leaving the base exposed to the environmental conditions. When it snows, the delineators and bases become covered with snow. There is no convenient way to operate a snowplow around the delineator or base for removal of the fallen snow.

The present invention allows the delineator to be disconnected from the base, the plow to remove snow from the surface above the base, and the delineator to be quickly reintroduced into the base. Further, in those situations where the delineator had been detached from the base prior to the snowfall, the plow may simply run over the base or mount without damaging the base or mount. A delineator must be placed on the base after the snow removal.

BRIEF DESCRIPTION OF THE DRAWINGS

FIG. 7 shows a plow blade moving snow or debris from above the base.

DETAILED DESCRIPTION OF THE PREFERRED EMBODIMENT

Figure 1:
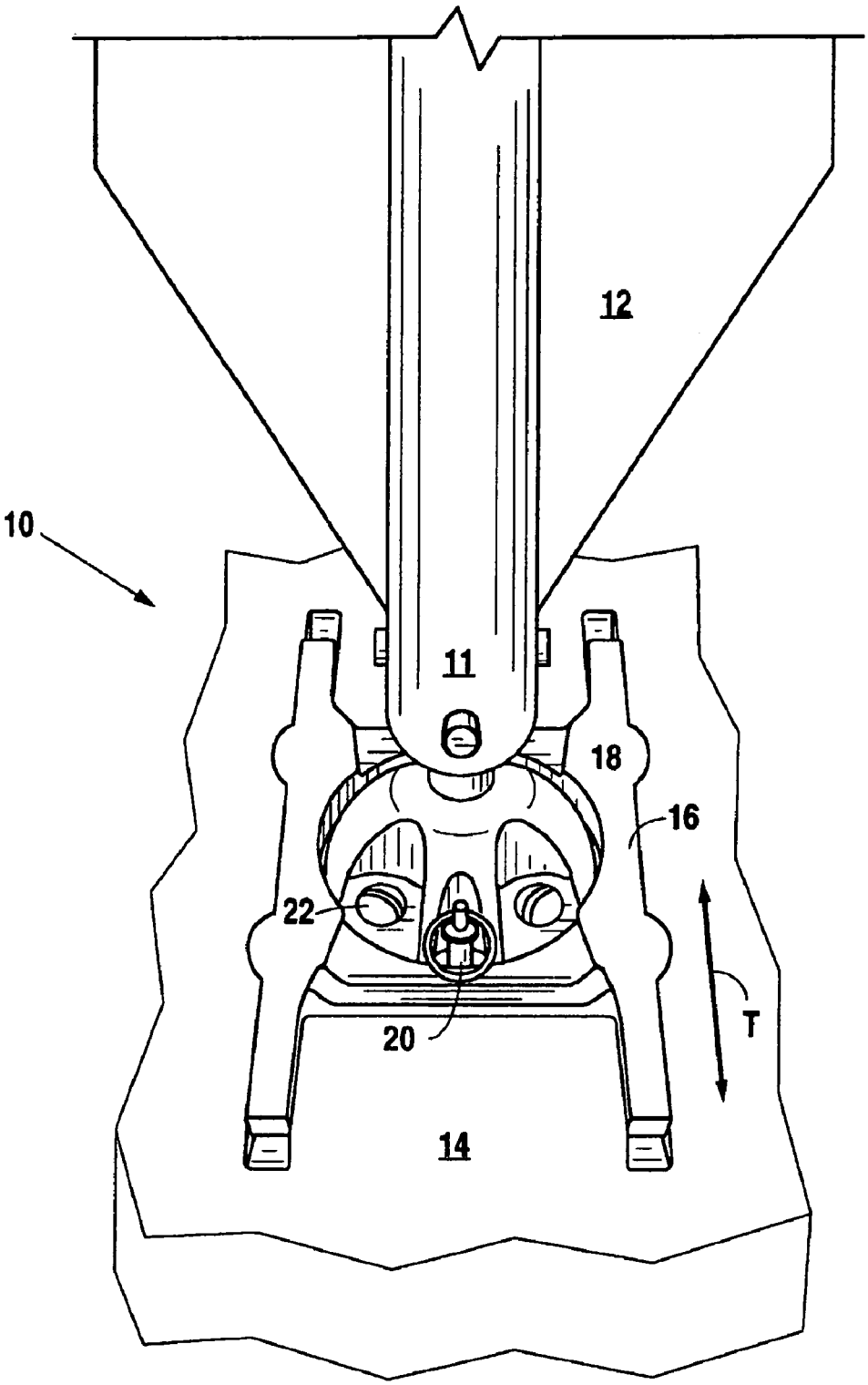
FIG. 1 illustrates a top, rear perspective view of a delineator system incorporating the base member of the present invention.
Figure 2:
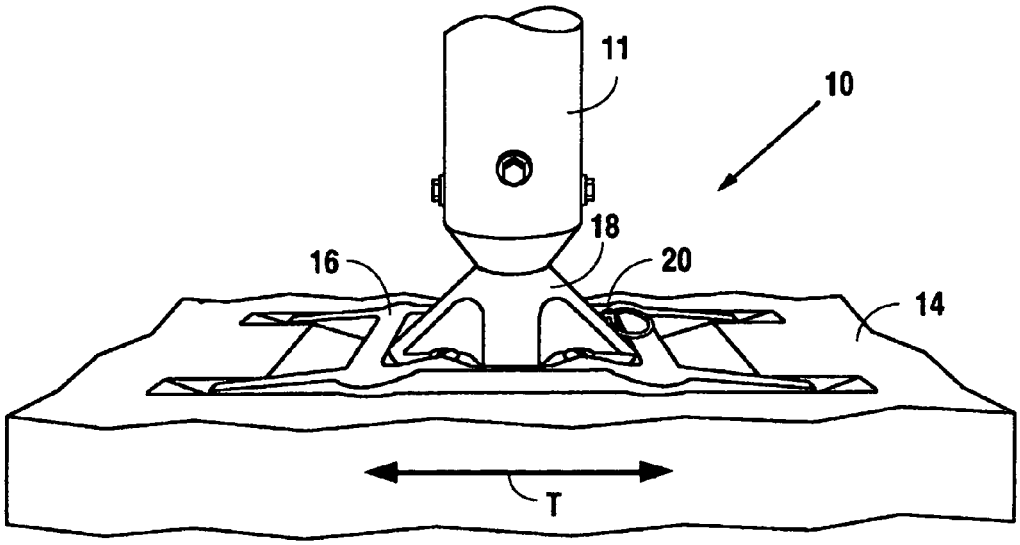
FIG. 2 shows a side perspective view of the system of FIG. 1.

FIG. 1 illustrates a top, rear perspective view of a delineator system (10) with a delineator releasable affixed to a plowable base of the present invention. FIG. 2 illustrates a side elevational perspective view.

A delineator post (11) with a section of signage (12) attached thereto is mounted to a support surface (14) by the base member (16) of the present invention. The support surface is generally the highway surface and the base member is permanently affixed to this surface. In the figures only a section of the support surface is illustrated. The highway surface (14) has a direction of traffic T indicated by the arrow. Normally the direction of traffic would be toward the signage (12), but occasionally a sign is misdirected. The delineator is designed to yield or collapse when impacted from either direction, but not when impacted in a cross traffic direction.

The lower knuckle (18) of the post (11) is easily and rapidly detachable from the base member (16) by releasing the detent latch (20) and rotating the knuckle (18) about the mounting studs (21). The complete operation of such a releasable knuckle is taught in U.S. Pat. No. 6,616,369, which is incorporated herein by reference for all purposes.

A snowplowable base member is a generally low profile structure with a ramping or sloping top surface to allow a plow blade to slide up and over the reflector lens housed in the base member. The base member is normally permanently affixed to the road surface and hold or retains the reflector lens. U.S. Pat. Nos. 5,277,513 and 5,454,664 teach the general construction and function of such a base member. However in the present invention the lens has been eliminated and central section of the base redesigned to accept a knuckle element of a delineator system.

Figure 3:
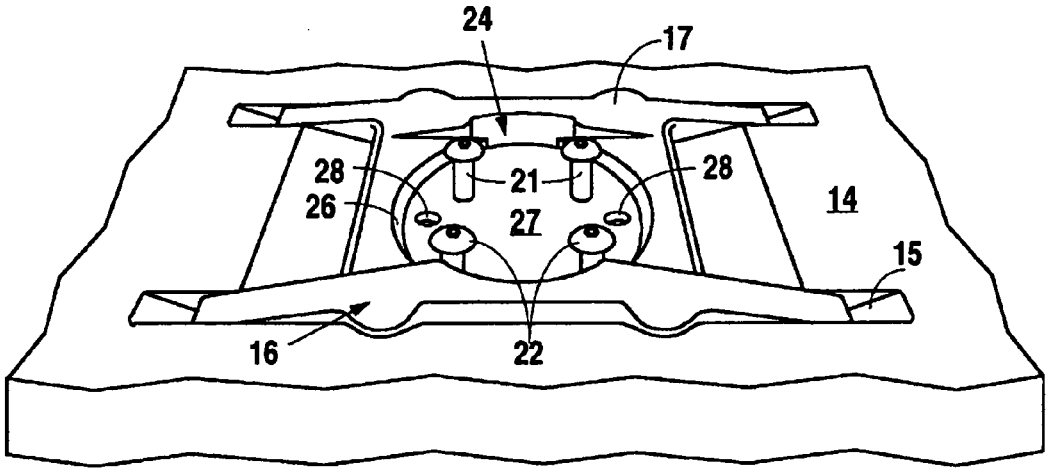
FIG. 3 is a side perspective view of the base of the present invention affixed in a support surface without the traffic delineator post member.
Figure 2A:
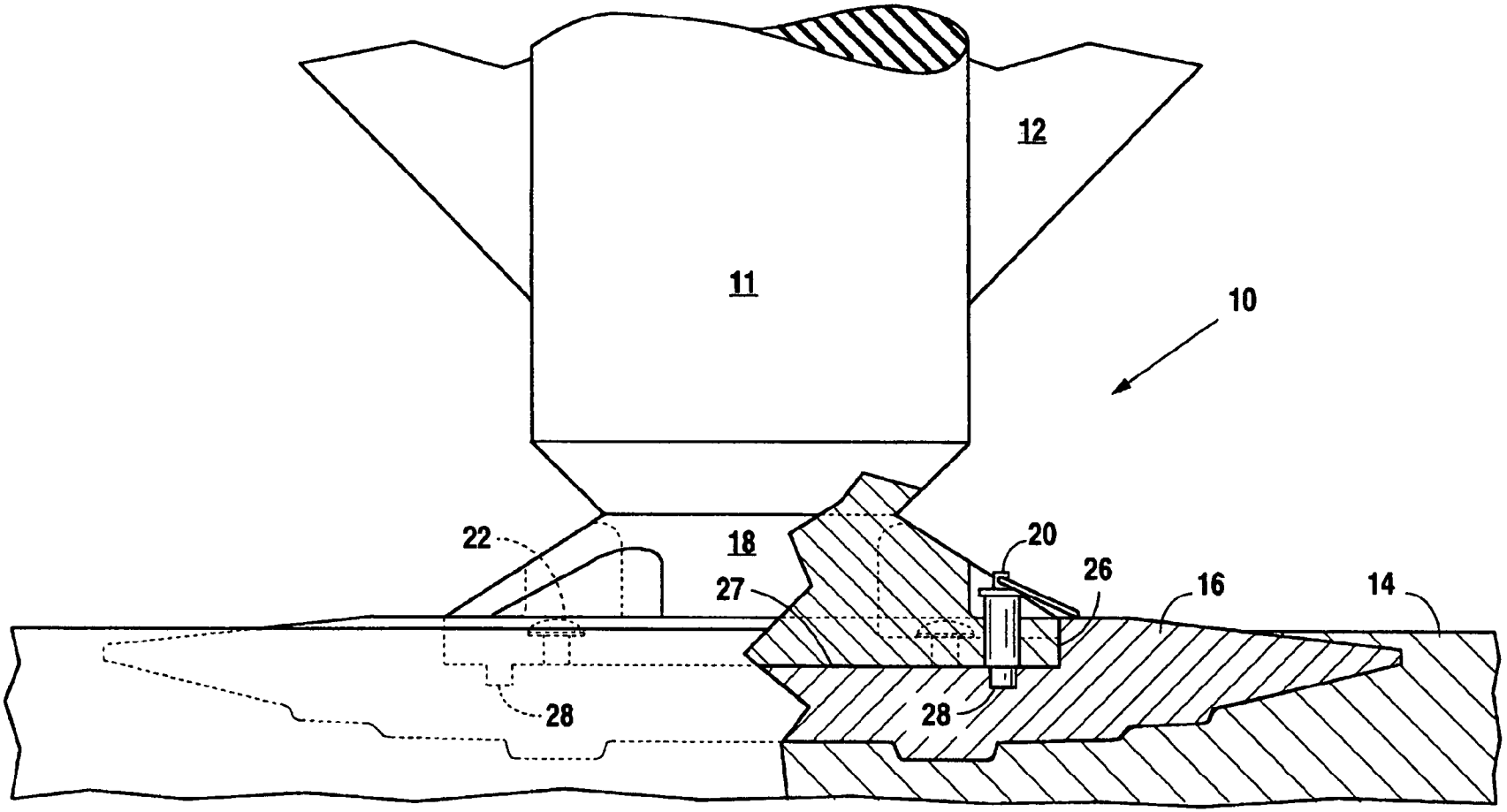
FIG. 2A illustrates a side elevation plan view of the system of FIG. 2 in partial cross-section.

FIG. 2 shows a side elevation plan view of the delineator system (10) with a partial cross-sectional view of the base (16) dispositioned in grooves 15 (FIGS. 3 and 5) in the highway surface (14). FIG. 3 illustrates a perspective view of the design of the present inventive base (16).

As may be seen in FIGS. 2 and 3, the central section (24) of the base body (17) has been redesigned to accept a knuckle element (18). A large circular notch (26) is provided in the base body (17) with four equally spaced apart, upwardly extending studs (21). Each stud has a flared head portion (22) which has a larger diameter than the stud (21). Detent holes (28) in the bottom (27) of the notch (26) accept the detent lock pin (20) of the knuckle element (18).

The knuckle (18) is placed over the central section with the stud head portions aligned with stud receiving openings in the knuckle. The knuckle is urged downwardly over the stud heads (22) and then rotated to allow the head portions (21) to slide over shoulders on the knuckle. This retains the knuckle to the base. The detent lock pin (20) is inserted through a hole in the knuckle and extends into the detent hole (28) in the bottom of the central circular notch (26) of the base body (17). The detent lock pin cooperates with the detent holes to restrict rotation of the knuckle in the base and keeps the head portions of the stud in contact with the shoulder of the knuckle. Thus, when the delineator post (11) is impacted, it merely deflects, collapses or folds about the flexing knuckle, but is retained in the base.

Figure 4:
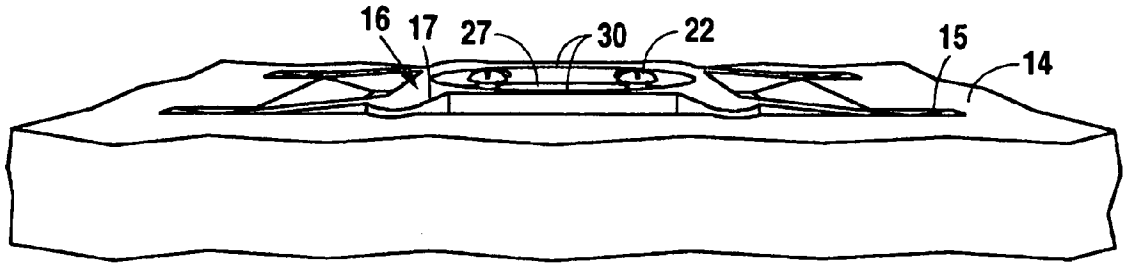
FIG. 4 is a side elevational view of the base of FIG. 3.

FIG. 4 illustrates a side elevational view of the base (16) affixed within grooves (15) in the highway or support surface (14). The heads of studs (22) do not extend above the top-most surface (30) of the base body (17). When the delineator is removed, a snowplow blade or other clearing implement will not catch the studs and pull the base from the supporting surface.

Figure 5:
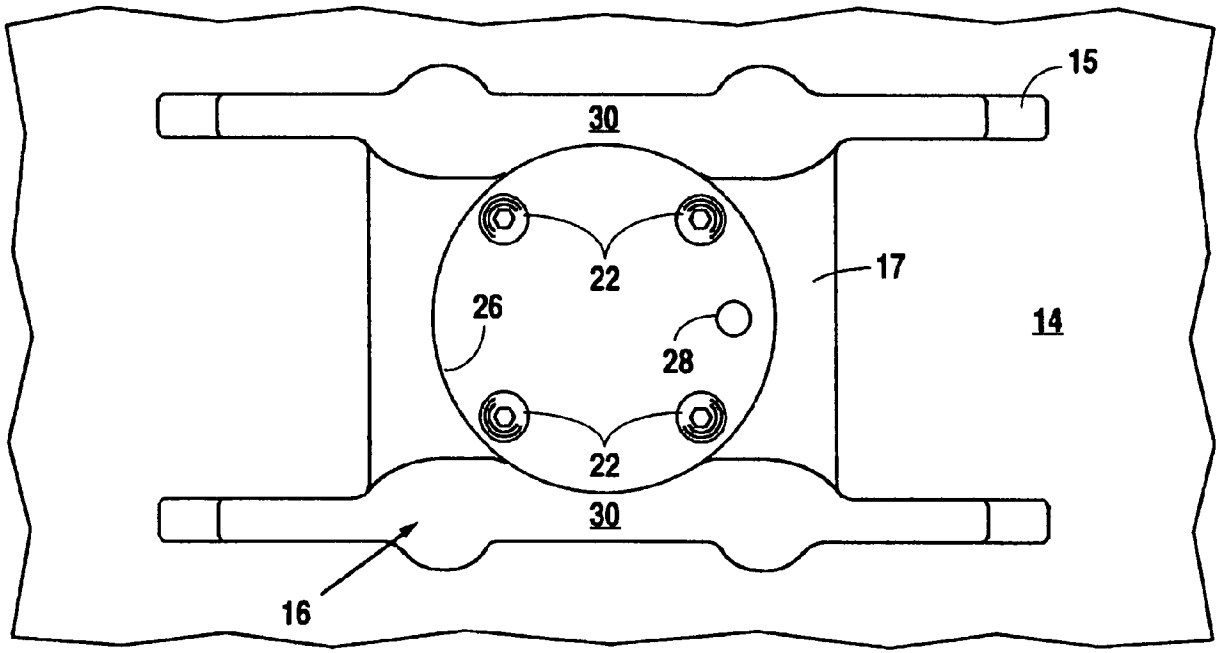
FIG. 5 is a top view of the base of FIG. 3.

FIG. 5 shows a top view of the base (16) in the support surface (14). Only one detent hole (28) is being utilized in this embodiment.

Figure 6:
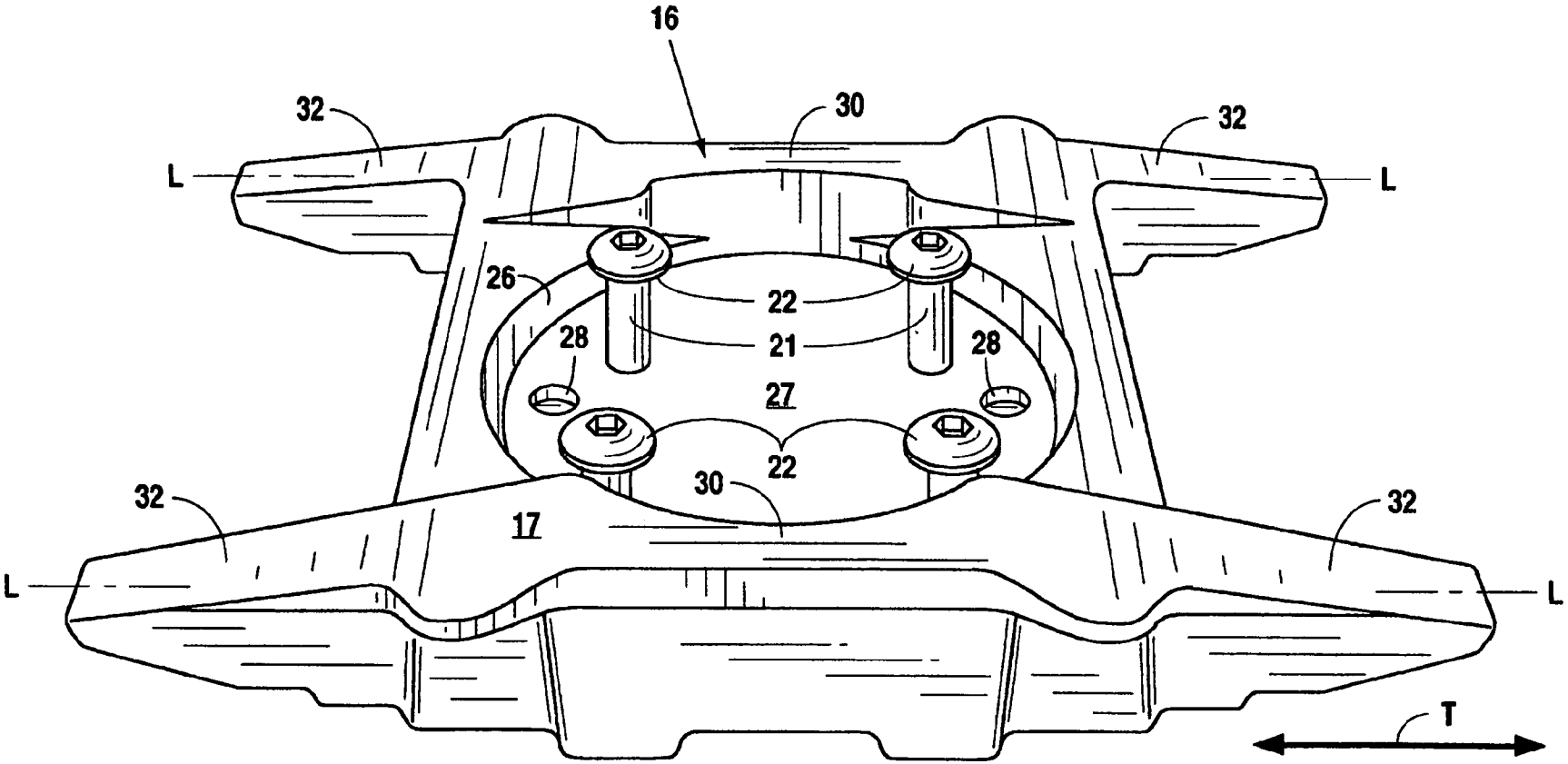
FIG. 6 is a top, side perspective view of the base of the present invention not attached to or in a support surface.

FIG. 6 illustrates the base (16) before it is affixed within the support surface. Leg portions (32) of the base extend outwardly in the direction of traffic from the body of the base and slide into the grooves cut or formed in the support surface. The leg portions (32) have longitudinal axes L which run or extend generally parallel to the direction of traffic T. Each leg is sloped or ramps downwardly along the longitudinal axis from the top-most surface (30) of the body member (17) to first ends (40) and second ends (42) of the body member (17). The first and second ends (40) and (42) extend below the top of the support surface (14) when placed in grooves (15) in the surface (14).

Figure 7:
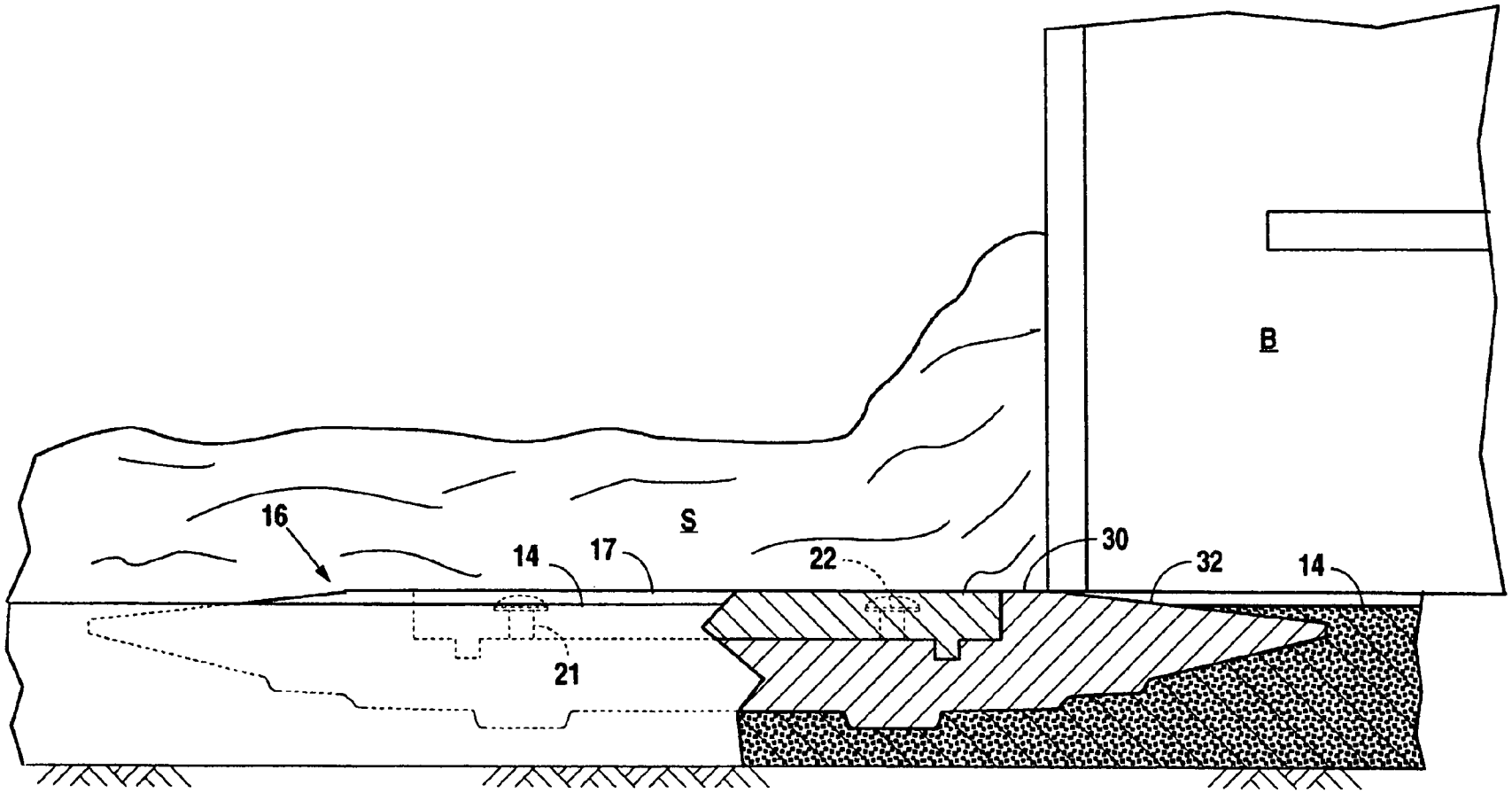
FIG. 7 is a side elevation plan view of the base of the present invention in a road surface without the traffic delineator.

FIG. 7 shows that a delineator post has been detached from the base (16). A plow blade B has been urged along the sloping leg portions (32) in the direction of traffic up to the top-most surface (30) of the body member (17). In the illustration, snow S is shown as being removed from the highway surface (14), but it should be understood that any debris could be cleaned from the surface (14). As the blade B reaches the top-most surface (30), it will continue over the base (16), but will not contact the stud heads (22).

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

The invention claimed is:

1. A recessed delineator base for disposition in grooves in a support surface, said surface having a direction of traffic thereon, comprising:

a body member with leg portions attached thereto and extending outwardly from said body member along said direction of traffic and a central circular notch formed in said body, said notch having a plurality of studs projecting upwardly from a bottom of said central circular notch, said studs having head portions extending no higher than the top-most surface of said body member, and a plurality of detent receiving holes in said bottom of said central circular notch.

2. The recessed delineator base of claim 1 wherein said leg portions have longitudinal axes extending generally parallel to said direction of traffic and said leg portions gradually slope downwardly along said longitudinal axes from said top-most surface of said body member to first and second ends of said leg portions.

3. The recessed delineator base of claim 2 wherein said first and second ends of said leg portions extend below said support surface within said grooves.

* * * * *